United States Patent [19]

Wilfong et al.

[11] Patent Number: 4,515,262

[45] Date of Patent: May 7, 1985

[54] COIN SLIDE

[75] Inventors: Evan C. Wilfong; Tesfaye Anno, both of Philadelphia, Pa.

[73] Assignee: Equipment Systems & Devices, Inc., Philadelphia, Pa.

[21] Appl. No.: 479,188

[22] Filed: Mar. 28, 1983

[51] Int. Cl.[3] ..... G07F 5/06

[52] U.S. Cl. ..... 194/1 G; 194/55

[58] Field of Search ..... 194/1 G, 55–60, 194/92, 93, 102, DIG. 2

[56] References Cited

U.S. PATENT DOCUMENTS

| | | | |
|---|---|---|---|
| 3,621,965 | 11/1971 | Eicken | 194/59 |
| 4,098,385 | 7/1978 | McNally | 194/55 |
| 4,350,240 | 9/1982 | Gitlin et al. | 194/92 |

*Primary Examiner*—F. J. Bartuska

*Attorney, Agent, or Firm*—Steele, Gould & Fried

[57] ABSTRACT

An improved coin slide of the type that includes a sturdy body having a medial mounting flange and a slide movable relative to the body between a coin receiving position and a vending position is disclosed. The slide is provided with a plurality of transversely arranged core receiving openings to receive therein interchangeable functional and non-functional cores in a manner to permit easy change of the vending price. A lever checking mechanism is secured in the body forwardly of the flange and includes coin checking levers in pivotal arrangement in longitudinal alignment with the cores. A coin stripper including a coin stop and a spring arm which biases between the body and the coin stop is secured below the lever checking mechanism. The spring arm biases the coin stop upwardly immediately forwardly of the levers to prevent rearward withdrawal of the coins after the slide has been moved to the vending position. In a preferred embodiment, a coin stripper plate is secured below the levers to discourage unauthorized pivoting of the levers.

19 Claims, 7 Drawing Figures

10
14
16
18
20
22
24
42
44
46
52
66
68
70
74
104
122
7

COIN SLIDE

FIELD OF THE INVENTION

The present invention relates generally to coin mechanisms for use in the vending machine industry, and more particularly, is directed to an improved multi-coin slide suitable for use with machines which are activated by a mechanical type coin slide, for example, washing machines, drying machines, stamp vending machines and the like.

BACKGROUND OF THE INVENTION

Coin slides have long been utilized in the vending machine industry to accept coins, to check the coins for denomination and authenticity prior to vending and then to receive and store the coins following vending for later collection by the owner or manager of the establishment. More recently, as prices have begun to rise and as vending operations have become more costly, the need has arisen to provide coin slides capable of accepting increased numbers of coins. More recent improvements in the coin slide industry have been directed toward accepting coins in vertical orientation to thereby conserve space and to present a device that is both compact and reliable.

As set forth in U.S. Pat. No. 4,350,240, which patent is owned by the assignee of the present application, improved facilties have now been designed which render the existing vertical type coin slides capable of rapid and easy price adjustment to thereby enable vending machine operators to quickly adjust the coin slides to either a higher vending price or to a lower vending price, in accordance with day-to-day marketplace requirements. Interchangeable cores are provided to allow price adjustment without major disassembly of the component parts of the coin slide.

While the device of U.S. Pat. No. 4,350,240 incorporated many improved construction features which were particularly designed to minimize the acceptance of bad coins and to discourage tampering, experience has proved that even the improved coin slide of U.S. Pat. No. 4,350,240 could sometimes be manipulated in a manner to retrieve the inserted coins after the vending cycle had been initiated or to depress one or more coin checking levers without using coins. The present invention incorporates additional construction features to prevent such unauthorized tampering and withdrawal of the vended coins.

SUMMARY OF THE INVENTION

The present invention relates generally to the field of coin slides for coin operated vending machines, and more particularly, is directed to an improved coin slide featuring improved means to discourage tampering.

The coin slide of the present invention includes a body having an integral flange for securely mounting the coin slide in the vending machine. An integral handle and slide plate is longitudinally movable relative to the body and is provided with a plurality of elongated slots for selectively receiving therein any one of a plurality of interchangeable cores for easily setting the vending price. The cores are divided into functional and non-functional cores, that is the functional cores are provided with slots specifically sized for receipt therein of coins of specified denomination. Preferably, five elongated slots are provided. If less than five coins are required to establish the vending price, then the remaining slots must be equipped with non-functional cores to thereby facilitate operation of the slide upon receipt of the correct number and denomination of coins required.

The interchangeable, functional cores are provided with means to prevent rearward operation of the slide when the improper number and denomination of coins is inserted into the slide and to permit rearward movement of the slide when the correct combination of coins has been inserted. The core accepting slots in the slide are completely interchangeable through the use of the interchangeable functional and non-functional cores and the coin slide can be made to accept any combination of coins of any denomination in a readily adjustable manner without requiring disassembly of any of the components of the coin slide. Rather, the slide is designed so that the interchangeable cores are rearwardly exposed when the slide is urged to its rearwardmost position whereby the cores can be readily changed without disassembling the coin slide itself.

In order to prevent the possibility of jamming or otherwise treating the coins in an unauthorized manner to possibly remove the coins forwardly after the vending operation has been inititated, the improved coin slide of the present invention has been provided with a coin stripper which is designed to close ahead of the coin after the coin has been rearwardly urged for vending purposes. The coin stripper is automatically interposed between the coins and the front of the machine by function of a pair of spring arms and is designed to absolutely prevent the coins from being pulled rearwardly through the coin slide after the vending cycle has been initiated.

In addition to the provision for the new coin stripper, a novel coin stripper plate has also been designed and provided below the coin stripper in a manner whereby the coin stripper plate functions both to secure the coin stripper in place and also to prevent the possibility of inserting a tool to force one or more of the coin checking levers downwardly without the presence of a coin in the functional core associated with that particular lever.

It is therefore an object of the present invention to provide an improved coin slide of the type set forth.

It is another object of the present invention to provide a novel improved coin slide including a coin stripper which is automatically insertable between a rearwardly urged coin and the front of the coin slide to prevent removal of the coin once the vending cycle has been initiated.

It is another object of the present invention to provide a novel, improved slide which comprises a new coin stripper and coin stripper plate positioned below the lever checker mechanism to prevent unauthorized bending of the levers and the unauthorized removal of coins forwardly following the start of the vending operation.

It is another object of the present invention to provide a novel improved coin slide that is relatively simple in construction, virtually tamper-proof when installed and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
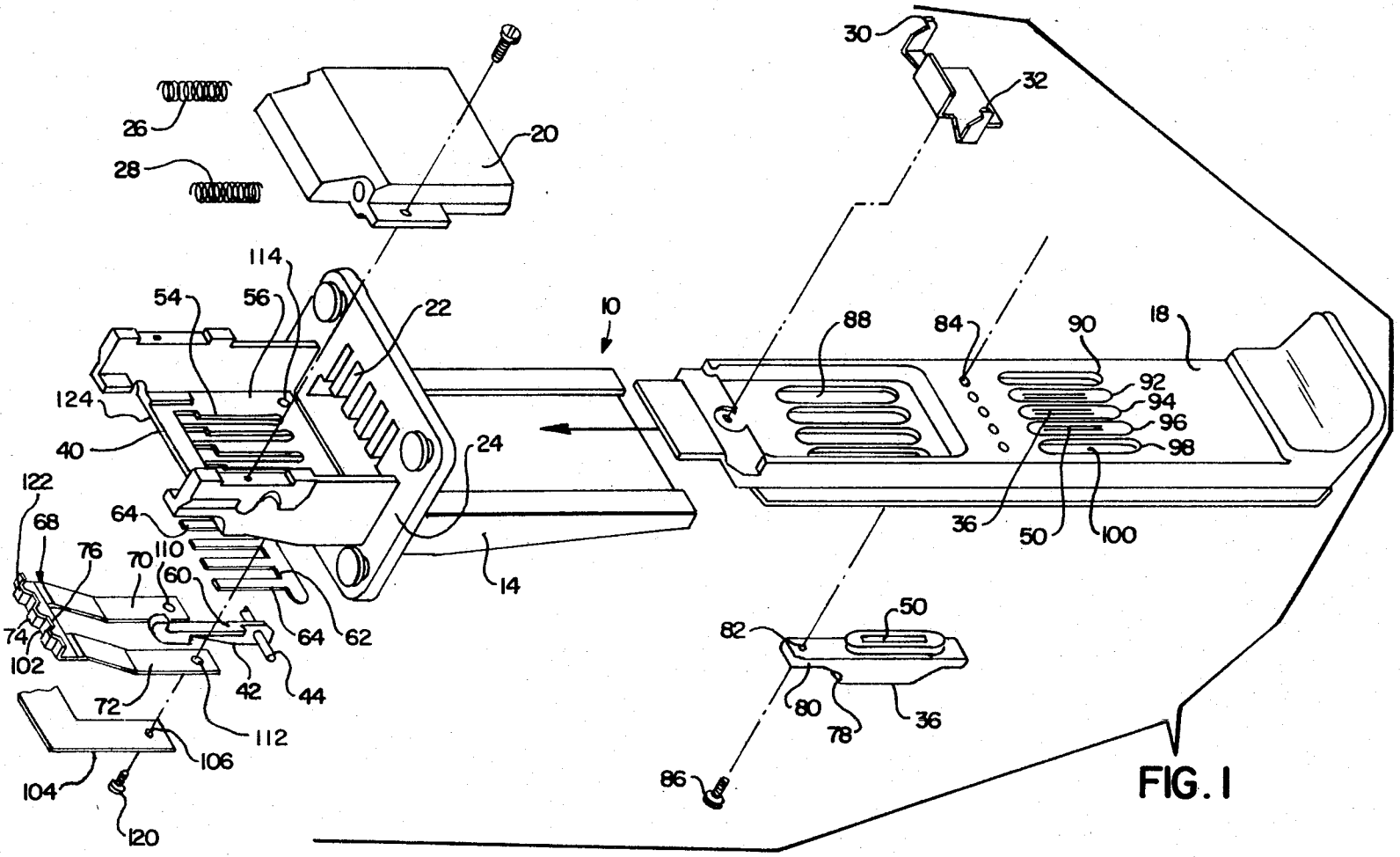
FIG. 1 is an exploded, partial, perspective view showing the functional elements of the coin slide of the present invention.

Although specific terms are used in the following description for the sake of clarity, these terms are intended to refer only to the particular structure of the invention selected for illustration in the drawings and are not intended to define or limit the scope of the invention.

Referring now to the drawings, there is illustrated in FIG. 1 a coin slide generally designated 10 which is suitable for initiating the vending cycle in numerous types of vending machines, for example, washing machines and drying machines (not shown) of the type generally installed in coin operated laundries, apartment buildings and the like.

The coin slide 10 comprises generally a sturdy body 14 which incorporates an integral face flange 24 for securing the coin slide to a front panel of a vending machine (not shown) in the usual manner. A slide 18 includes a forward handle 16 and is movable longitudinally of the body 14 for vending machine operation purposes upon the insertion of the correct number and denomination of coins, in well known manner.

As best seen in FIG. 1, the slide 18 is equipped with a plurality of parallel, longitudinally aligned, transversely spaced, core receiving openings 90, 92, 94, 96, 98 for receipt therein of a plurality of interchangeable cores including functional cores 36 and non-functional cores 100. While a plurality of five openings 90–98 are illustrated, it will be appreciated that more or fewer core receiving openings could be provided and still come within the meaning and scope of this invention. The functional cores 36 are provided with coin receiving openings 50, which openings are specifically dimensioned and configured to receive and initially check therein any pre-selected denomination and size of coin.

Still referring to FIG. 1, it will be noted that each interchangeable core is formed with a rearward mounting flange 80 having an opening 82 therethrough. Cooperating threaded openings 84 are provided in the slide 18 in alignment with each of the core receiving openings 90-98 whereby an interchangeable core can be readily connected within its corresponding core receiving opening by utilizing a small, threaded bolt 86 in known manner. It will be observed that the mounting flange 80 of each interchangeable core 36, 100 and each threaded bolt 86 will be exposed rearwardly of the lever checking mechanism 40 when the slide 18 is fully rearwardly urged relative to the coin slide body 14. In this manner the bolts 86 will be exposed when the slide 18 is in its rearwardmost position. See FIG. 4. When the slide is in the FIG. 5 position, it is noteworthy that the plurality of bolts 86 may be threadedly engaged or disengaged within the threaded openings 84 to thereby quickly and easily change one or more of the interchangeable cores 36, 100. Accordingly, it is a feature of the slide construction to permit change of the vending price required for operation of the coin slide 10 without requiring disassembly of any parts other than the interchangeable cores themselves.

Preferably, a core storage area 88 is provided immediately rearwardly of the core receiving openings 90, 92, 94, 96, 98 in a position to always be shielded by the flange 24 so that the storage area 88 is never exposed forwardly of the flange 24. One or more functional or non-functional cores 36, 100 may be stored within the storage area 88 to thus provide ready access to functional cores 36 of substantially all denominations or alternately to provide access to a plurality of non-functional cores 100. The storage area 88 will also be exposed rearwardly of the lever checking mechanism 40 when the slide is moved to the position illustrated in FIG. 4 to permit ready access to additional cores 36, 100.

Still referring to FIG. 1, it will be observed that the flange 24 is equipped with five coin receiving grooves 22 in longitudinal alignment with the central axes of the respective coin receiving openings 90, 92, 94, 96, 98 whereby the coin receiving grooves 22 cooperate with the coin slots 50 in the functional cores 36 to provide an additional coin checking function. So long as a coin 52 can insert within the coin slot 50 in a functional core 36 and through the coin receiving groove 22 in the face flange 24, there will be no resistance to rearward movement of the slide 18 toward initiation of the vending cycle.

Figures 2, 3, 4, 5:
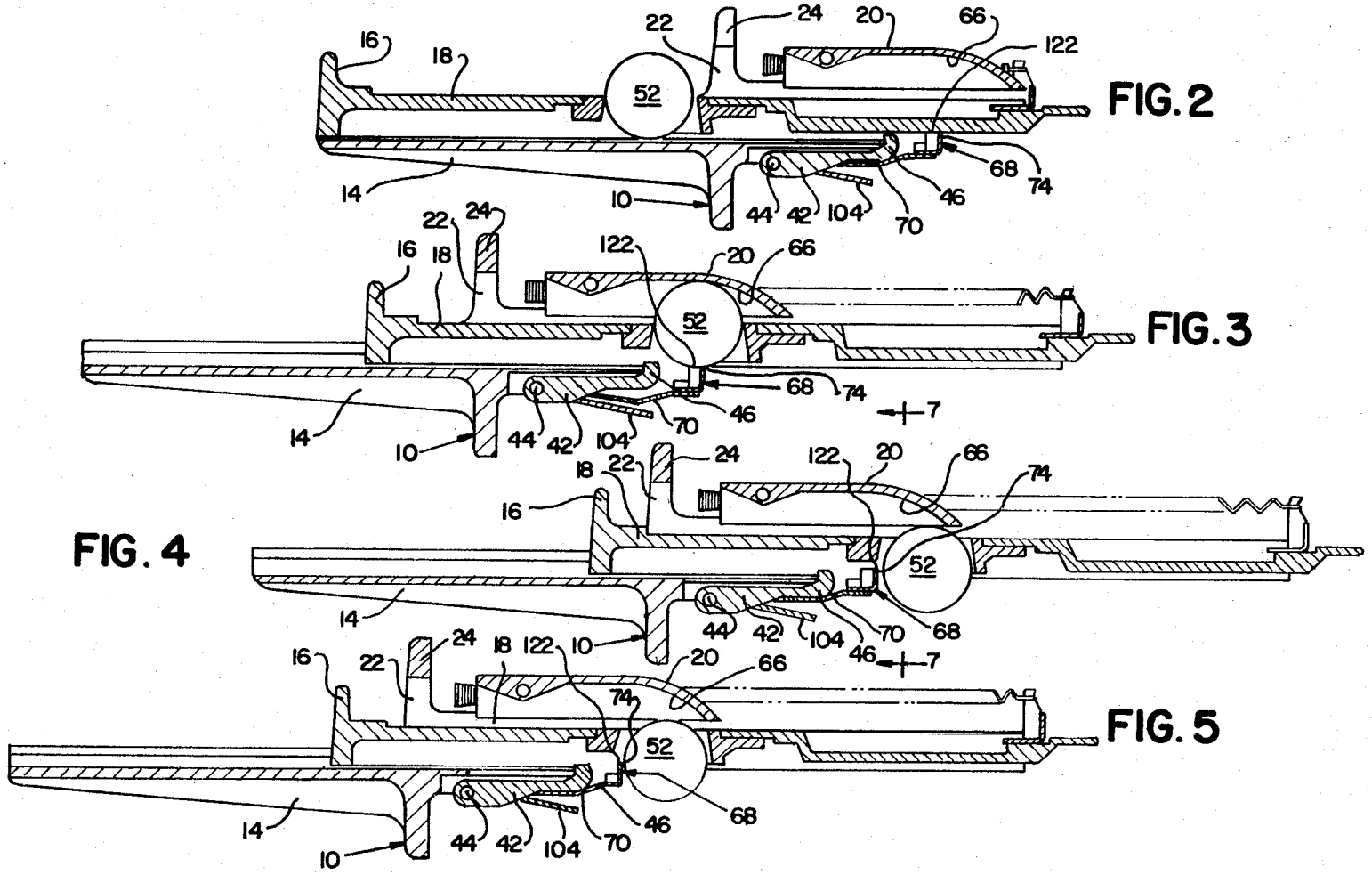
FIG. 2 is a partial cross-sectional view showing the position of the slide during the coin insertion operation.
FIG. 3 is a cross-sectional view similar to FIG. 2 showing the position of the parts as the coins pass the lever checking mechanism and depress the coin stripper.
FIG. 4 is a cross-sectional view similar to FIG. 3 showing the slide in the second coin drop position
FIG. 5 is a cross-sectional view similar to FIG. 4 showing the slide moved to the first coin drop position.
Figure 6:
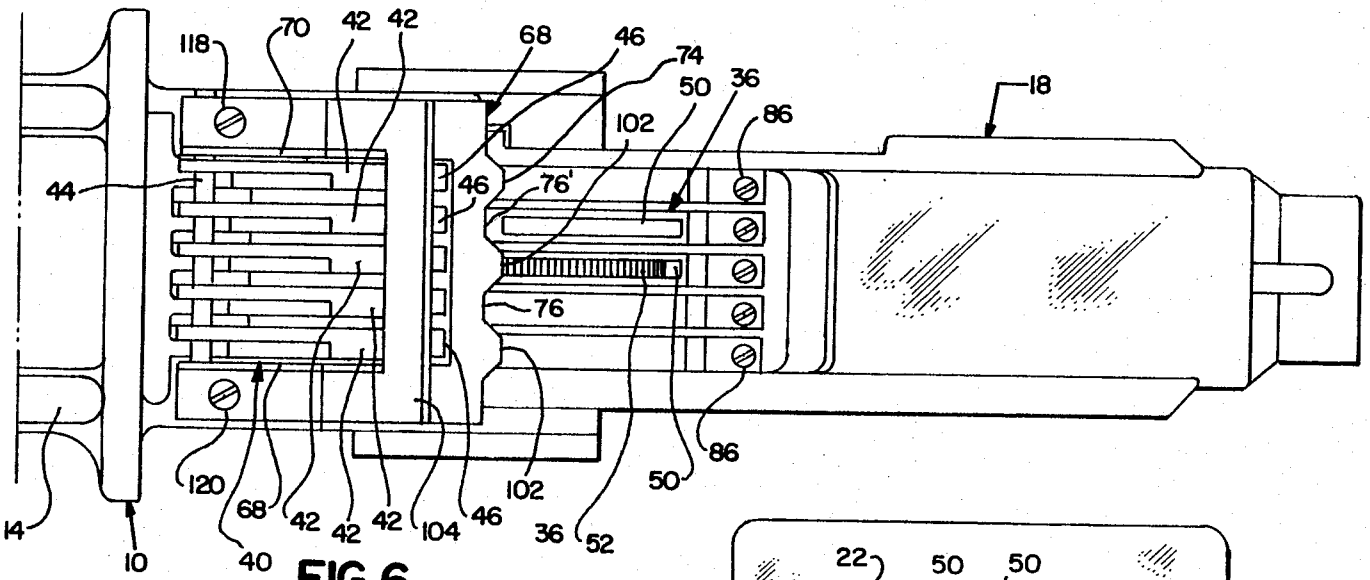
FIG. 6 is partial, enlarged, bottom plan view, looking from the bottom of FIG. 4.
Figure 7:
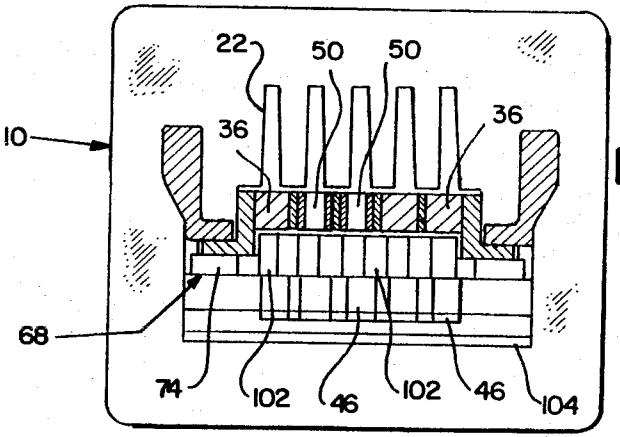
FIG. 7 is an enlarged, cross-sectional view, looking from line 7—7 on FIG. 4 in the direction of the arrows.

In known manner, a pair of operating springs 26, 28 bias between respective lugs 30, 32 which are rearwardly affixed on the slide 18 and stationary portions of the bridge construction 30. The springs 26, 28 normally bias the slide 18 to an initial, forward, coin accepting position, as illustrated in FIG. 2. When the slide 18 is urged rearwardly upon insertion of a plurality of coins 52 within the interchangeable core coin slots 50, the bias of the springs 26, 28 must be overcome by rearwardly directed forces on the handle 16 applied by the hand of the user (not shown) in the known manner.

As the slide 18 is pushed to feed the coins rearwardly of the flange 24 through the coin receiving grooves 22 therein, the shaped interior surfaces 66 of the bridge 20, which may be cams, function to force the coins 52 downwardly through the elongated coin receivers 54 of the lever checking mechanism 40. (See FIG. 3.) The downward pressure exerted by each coin 52 acts upon a respective lever ledge 60 of each lever 42 against the bias of a spring finger 64 of the leaf spring 62 to pivot each lever hook 46 about the pivot shaft 44 to depress the lever hooks downwardly through the coin receivers 54 until the entire hook configuration 46 of each lever is urged downwardly below the plane of the lever checking mechanism top surface 56. When all of the hooks 46 have been pushed below the planar top surface 56, the respective locking edges 78 of the plurality of interchangeable cores cannot engage the hooks 46 because the cores 36 ride rearwardly above the top surface 56.

See FIGS. 3, 4, 5. Therefore, the slide 18 can then be pushed further rearwardly toward vending contact.

In order to prevent possible retrieval of the coins 52 after they have satisfactorily depressed the plurality of levers 42 to allow further rearward movement of the slide to initiate the vending operation, a coin stripper 68 is provided immediately below the leaf spring 62. As illustrated in FIG. 1, the coin stripper 68 is generally U-shaped in configuration and includes a pair of spring attaching legs 70, 72 and a shaped web or coin stop 74 connected therebetween. The coin stop 74 comprises one or more vertical grooves 76, 76' in longitudinal alignment with one or more of the core receiving openings 90, 92, 94, 96, 98. The vertical grooves provide an irregular coin stop surface whereby any coin 52 within a core 36 that is aligned with a groove 76, 76' will fall into the cash box (not shown) before any coin that is within a core that is aligned with any rearwardly positioned portion 102 of the coin stop 74. Thus, by the simple expedient of providing one or more vertical grooves 76, 76' in the coin stop 74, some of the coins will be allowed to drop into the cash box ahead of others of the coins, thereby preventing any tendency of the mechanism to jam due to too many coins falling at the same time.

In the embodiment of the coin stripper 68 as illustrated, two vertical grooves 76, 76' are shown and therefore, a plurality of two coins of the five possible coins vended in the mechanism will drop prior to the dropping of the other three coins. It will be appreciated that more or fewer vertical grooves 76, 76' can be provided in the coin stop 74, depending upon the number of coins that can be handled by the coin slide 10.

The spring legs 70, 72 of the coin stripper 68 are connected to normally bias the coin stop 74 upwardly toward the underside of the lever checking mechanism top 56 (see FIG. 2) whereby the coin stop will normally be positioned above the top 56 and rearwardly of the rear edge 124 of the top 56 in position to be contacted by the coins 52 as the coins are rearwardly carried by the slide 18. As illustrated in FIG. 3 the coins will ride over and depress the coin stripper 68 against the bias of the legs 70, 72 during their rearward journey through the coin slide 10 until the coins reach the second coin drop position illustrated in FIG. 4. In the said second coin drop position, the spring legs 70, 72 will function to bias the coin stop 74 upwardly behind the coins 52 to thereby positively prevent coin removal. The top 122 of the coin stop 74 is designed to extend to a height that is above the centerline of the coins 52 when the coins are rearwardly urged to the second coin drop position to thereby defeat any attempt to withdraw the coins by manipulating the slide forwardly.

It will be appreciated that more or fewer coins can be accommodated by the coin slide 10 by having more or less core receiving openings 90, 92, 94, 96, 98 cast in the slide 18 and by providing a similar number of flange grooves 22 and coin checking levers 42. By a simple expedient of laterally adding additional core receiving openings 90–98, flange grooves 22 and levers 42, it is contemplated that the coin slide of the present invention could be rather easily designed to accommodate numerous additional coins, for example, ten or twelve coins in lateral, spaced juxtaposition.

If, for example, the coin slide was constructed to handle ten such coins, it is then contemplated that the coin stop 74 would be provided with a plurality of perhaps five transversely spaced vertical grooves 76, 76'. In this manner, half of the coins would be provided with an early release position whereby five of the coins could first drop into the cash box (not illustrated) ahead of the remainder of the coins. Then, as the coin slide 18 was pushed further forwardly, the remaining coins could drop once they had cleared the forward faces 102 of the coin stop 74.

In order to prevent tampering with the levers 42 by manipulating a tool through the flange openings 22, a sturdy, bottom positioned coin stripper plate 104 has been provided below the lever checking mechanism 40. By so positioning the coin stripper plate 104, any tampering by inserting a tool to pivot one or more levers 42 about the common pivot shaft 44 can thus be prevented and discouraged by limiting the freedom of movement of the coin checking levers 42.

In order to simplify installation procedures, as illustrated in FIG. 1, the coin stripper plate 104 can be provided with laterally positioned openings 106. Similarly, the coin stripper 68 can be provided with laterally spaced openings 110, 112. Preferably, the respective right side openings 106, 110 vertically align and register to receive therethrough a single mounting bolt 118 Similarly, the left side mounting openings 106, 112 also vertically register and align to receive therethrough a single mounting bolt 120. The mounting bolts 118, 120 can then be threadedly secured within left and right threaded openings provided in the body 14 to secure a plurality of parts in a simplified and sturdy interconnection.

After all of the coins 52 have been released either through the vertical grooves 76, 76' when the slide is moved to the first coin drop position illustrated in FIG. 5 or after the coins 52 clear the forward face portions 102 of the coin stop 74 as illustrated in the second coin drop position in FIG. 4, the natural memory or spring of the coin stripper spring legs 70, 72 will function to urge the coin stop to close rearwardly of the coins 52 and thereby absolutely prevent such coins from being pulled back through the device. It is noteworthy that the coins 52 themselves ride over the top surface 122 of the coin stripper 68 as the coins are being forwardly urged through the lever checking mechanism 40 to temporarily depress the coin stripper 68 against the bias of the spring legs 70, 72. See FIG. 3.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claim is:

1. A coin slide including a body and a flange adapted to be mounted upon a vending machine, comprising a slide means movable relative to the body between a forward coin receiving position and a rearward vending position, the slide means being provided with a plurality of longitudinally aligned coin receiving openings;

said coin receiving openings being respectively sized to receive and pass therethrough a coin of predetermined size;

lever checking means operatively secured to the body rearwardly of the flange, the lever checking means comprising pivotal levers, the levers of the lever checking means being contacted by coins as the slide means is moved rearwardly toward the said vending position; and coin stripper means secured to the body in partial registry with the lever checking means, coin stripper means comprising a coin stop and a spring arm secured to the coin stop, the coin stop being positioned forwardly of the coins when the slide means is moved to the vending position, whereby the coins cannot be urged forwardly of the coin stop after the slide means has been moved to the vending position prior to dropping into a cash box.

2. The coin slide of claim 1 wherein lever checking means comprises a planar top surface and wherein the coin stop extends upwardly above the top surface when the slide means is in its said coin receiving position.

3. The coin slide of claim 2 wherein the coins contact the coin stop and push the coin stop below the said top surface as the slide means is moved from the coin receiving position to the said vending position against the bias of the spring arm.

4. The coin slide of claim 3 wherein the spring arm biases the coin stop upwardly above the said top surface when the slide means is moved to the vending position.

5. The coin slide of claim 1 and coin drop delay means in the coin stripper means to vary the time when coins drop from the slide means into the cash box.

6. The coin slide of claim 5 wherein the coin drop delay means is formed in the said coin stop.

7. The coin slide of claim 6 wherein the coin drop delay means comprises a non-planar vertical wall in the coin stop.

8. The coin slide of claim 7 wherein the vertical wall comprises a plurality of forward vertical portions and a plurality of rearward vertical portions.

9. The coin slide of claim 8 wherein the pluralities of forward and rearward vertical portions define a plurality of vertical grooves.

10. The coin slide of claim 9 wherein the vertical grooves are positioned rearwardly of the lever checking means.

11. The coin slide of claim 9 wherein the vertical grooves longitudinally align with of the coin receiving openings, the coins in the said aligned coin receiving openings dropping into the cash box prior to the coins in the non-aligned coin receiving openings.

12. The coin slide of claim 1 and coin stripper plate means secured to the body in registry below the lever checking means to limit the pivotal movement of the levers.

13. In a coin slide of the type including a body having a flange adapted to be mounted to function a vending machine, a slide movable relative to the body between a coin receiving position and a vending position, the slide being provided with a plurality of longitudinally aligned coin receiving openings, the coin receiving openings being positioned forwardly of the flange when the slide is in the coin receiving position and rearwardly of the flange when the slide is in the vending position, the coin receiving openings being respectively sized to receive and pass therethrough coins of predetermined size, and a lever checking mechanism secured to the body rearwardly of the flange, the lever checking mechanism including a plurality of pivotal levers, the levers being in longitudinal alignment with the coin receiving openings, the improvement comprising a coin stripper means secured to the body to prevent forward movement of the coins after the slide has been moved to the vending position, the coin stripper means comprising a transverse coin stop and a spring arm biasing between the body and the coin stop.

14. The coin slide of claim 13 wherein the lever checking mechanism comprises a planar top surface and wherein the spring arm continuously tends to bias a top portion of the coin stop to a position above the top surface.

15. The coin slide of claim 14 wherein the spring arm secures the coin stop in the position that is located rearwardly of the lever checking mechanism.

16. The coin slide of claim 15 wherein the coin stop comprises a plurality of forward and rearward faces.

17. The coin slide of claim 16 wherein the forward and rearward coin stop faces define a plurality of vertical grooves in the coin stop.

18. The coin slide of claim 17 wherein the vertical grooves each longitudinally aligns with a coin receiving opening, whereby a first coin drop is defined to permit the coins in the aligned coin receiving openings to drop from the aligned coin receiving openings prior to coins in non-aligned coin receiving openings.

19. The coin slide of claim 18 and a coin stripper plate secured to the body below the lever checking mechanism, the coin stripper plate being positioned in the path of pivotal movement of the levers to limit the movement of the levers.

* * * * *